US007918042B2

(12) United States Patent
Ropog

(10) Patent No.: US 7,918,042 B2
(45) Date of Patent: Apr. 5, 2011

(54) THREE POSITION WING FOR SNOWPLOW

(75) Inventor: Jim Ropog, North Olmsted, OH (US)

(73) Assignee: Louis Berkman Winter Products Company, Cleveland, OH (US)

( * ) Notice: Subject to any disclaimer, the term of this patent is extended or adjusted under 35 U.S.C. 154(b) by 71 days.

(21) Appl. No.: 12/366,114

(22) Filed: Feb. 5, 2009

(65) Prior Publication Data

US 2010/0064554 A1 Mar. 18, 2010

Related U.S. Application Data

(60) Provisional application No. 61/096,573, filed on Sep. 12, 2008.

(51) Int. Cl.
*E01H 5/06* (2006.01)

(52) U.S. Cl. ..... 37/281

(58) Field of Classification Search ..... 37/266, 37/270, 274–281, 216; 172/782, 815, 784, 172/247

See application file for complete search history.

(56) References Cited

U.S. PATENT DOCUMENTS

| | | | | |
|---|---|---|---|---|
| 97,474 | A | 12/1869 | Beer | |
| 323,656 | A | 8/1885 | Franz | |
| 629,543 | A | 7/1899 | Bush | |
| 1,544,983 | A * | 7/1925 | Heinzen | 37/274 |
| 1,550,574 | A * | 8/1925 | Sargent | 37/274 |
| 1,672,490 | A | 6/1928 | Herchert | |
| 1,711,488 | A | 5/1929 | Bising | |
| 2,014,783 | A | 9/1935 | Schubert | |
| 3,477,151 | A | 11/1969 | Zanella | |
| 3,805,424 | A | 4/1974 | Renahan | |
| 3,845,517 | A | 11/1974 | Harris | |
| 4,073,077 | A | 2/1978 | Essel et al. | |
| 4,074,448 | A | 2/1978 | Niemela | |
| 4,077,139 | A | 3/1978 | Fagervold et al. | |
| 4,145,825 | A | 3/1979 | Bertolino | |
| 4,275,514 | A | 6/1981 | Maura | |
| 4,479,312 | A | 10/1984 | Turgeon | |
| 4,614,048 | A | 9/1986 | Melby | |
| 4,741,116 | A | 5/1988 | Engle et al. | |
| 4,962,600 | A | 10/1990 | Zellaha et al. | |
| 4,969,280 | A | 11/1990 | Thorneloe | |
| 5,411,102 | A * | 5/1995 | Nickels et al. | 172/781 |
| 5,505,268 | A | 4/1996 | McPherson et al. | |
| 5,809,672 | A | 9/1998 | Jones | |
| 5,819,444 | A | 10/1998 | Desmarais | |
| 5,829,174 | A | 11/1998 | Hadler et al. | |
| 5,848,654 | A | 12/1998 | Belcher, Jr. | |
| 5,860,230 | A | 1/1999 | Daniels | |
| 5,903,986 | A | 5/1999 | Parker | |
| 5,903,987 | A | 5/1999 | Nuske | |
| 5,921,326 | A | 7/1999 | Ragule | |
| 6,044,579 | A | 4/2000 | Hadler et al. | |
| 6,112,438 | A | 9/2000 | Weagley | |
| 6,154,986 | A | 12/2000 | Hadler et al. | |
| 6,298,585 | B1 | 10/2001 | Boulet | |
| 6,408,549 | B1 | 6/2002 | Quenzi et al. | |
| 6,442,877 | B1 | 9/2002 | Quenzi et al. | |

(Continued)

*Primary Examiner* — Robert E Pezzuto
(74) *Attorney, Agent, or Firm* — Emerson Thomson Bennett; Roger D. Emerson; Timothy D. Bennett

(57) ABSTRACT

A snowplow wing attached to the end of a snowplow blade may be manually adjusted into position to increase the operative width of the snowplowing surface, and otherwise capture or direct the flow of snow being plowed.

15 Claims, 15 Drawing Sheets

U.S. PATENT DOCUMENTS 6,681,505 B1 1/2004 Wells
6,877,258 B2 4/2005 Frey
7,134,227 B2 11/2006 Quenzi et al.
7,237,814 B2 7/2007 Handzlik

* cited by examiner

FIGURES 5A-5E
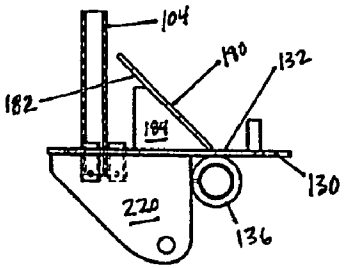
FIG. 5A
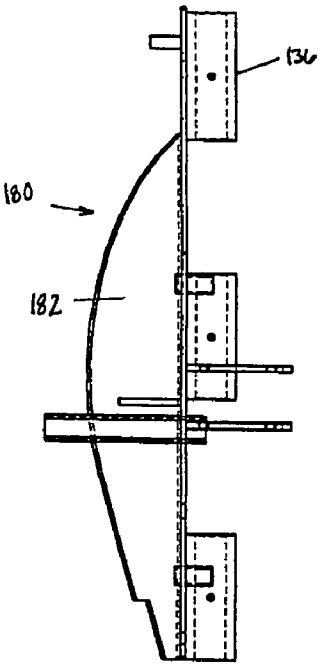
FIG. 5B
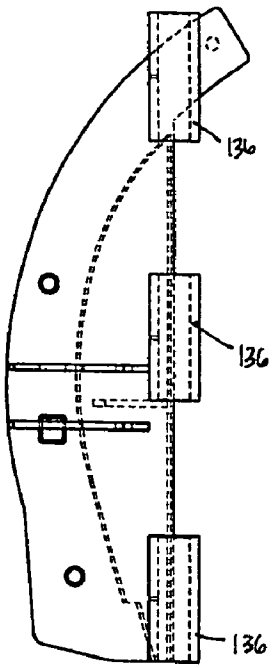
FIG. 5C
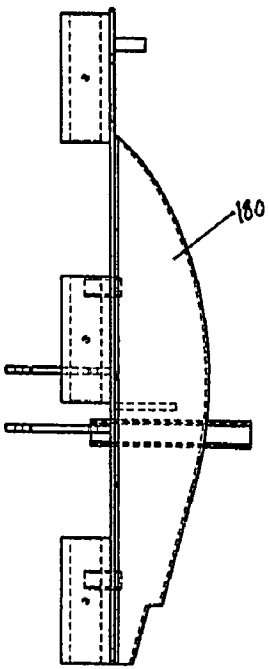
FIG. 5D
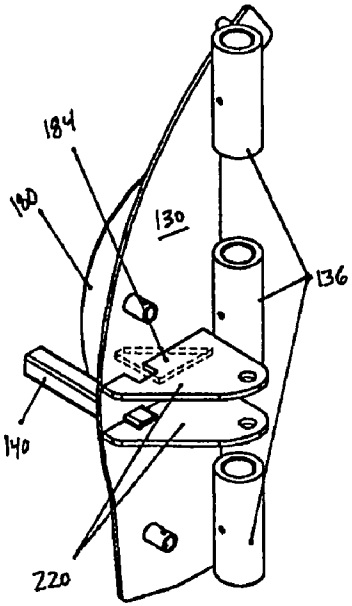
FIG. 5E 130
132
134
136
140
180
184
220
104

FIGURES 6A-6D
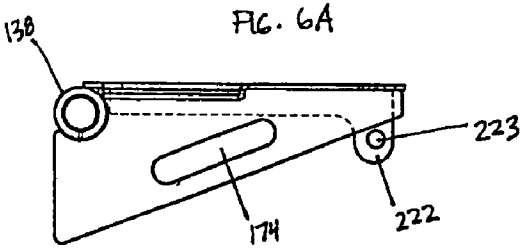
FIG. 6A
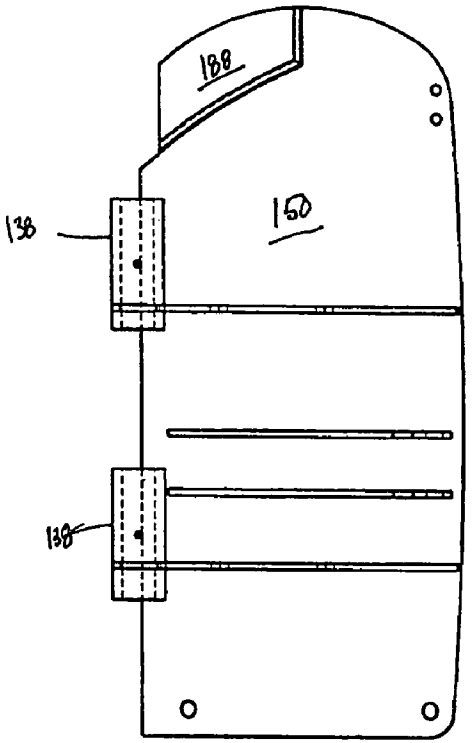
FIG. 6B
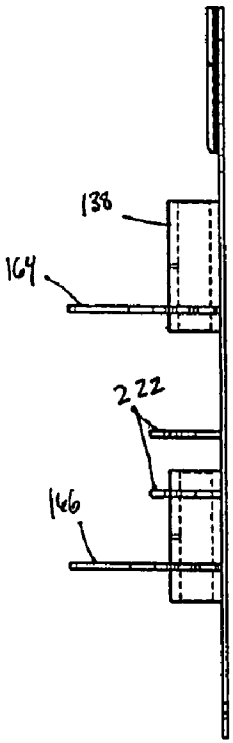
FIG. 6C
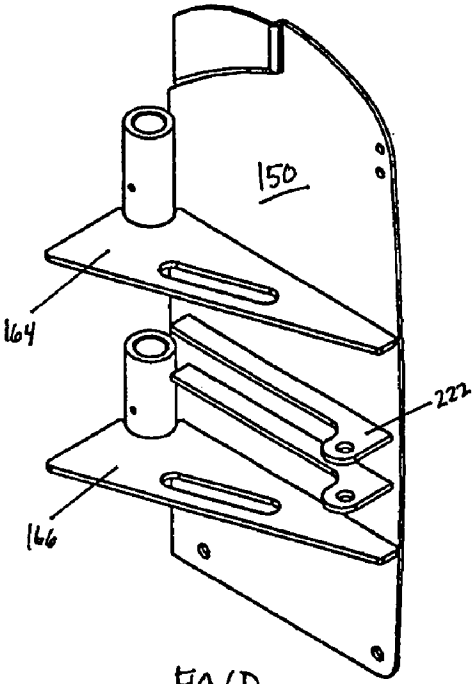
FIG. 6D

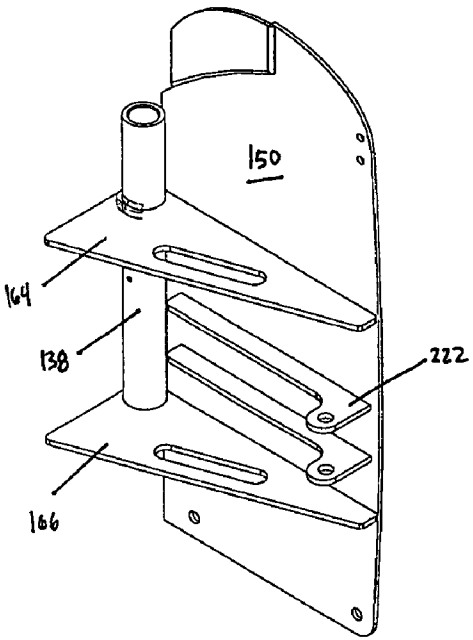
FIG. 6d
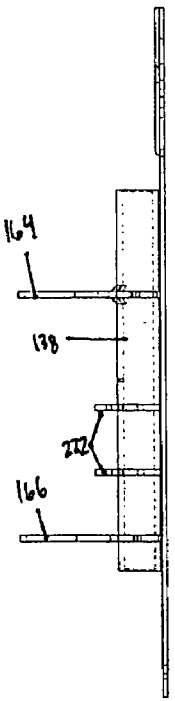
FIG. 6c
FIG. 6a - 6d
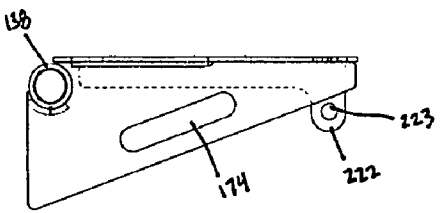
Fig. 6a
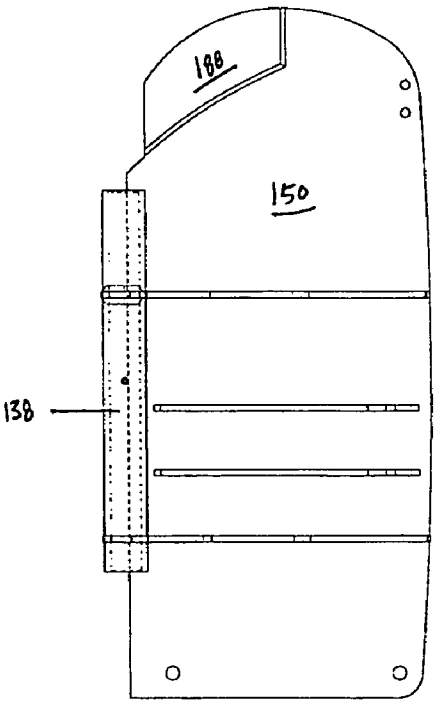
FIG. 6b 168
150
140
188
151
154

THREE POSITION WING FOR SNOWPLOW

This application claims priority to U.S. Ser. No. 61/096,573, entitled THREE POSITION WING FOR SNOWPLOW, filed Sep. 12, 2008 which is incorporated herein by reference.

I. BACKGROUND OF THE INVENTION

A. Field of Invention

This invention pertains to the art of snowplows, and specifically accessories to snowplows, and more specifically to a manually adjustable wing extension that can be added to the distal end or ends of a snowplow to increase its effectiveness or change its performance.

B. Description of the Related Art

It is known in the art to provide adjustable wings at the end of a snowplow. The wing assemblies are typically movable between forwardly angled positions, positions generally aligned with the snowplow blade, and in some instances, positions behind the snowplow blade. They are also often adjustable independent of the main snowplow blade. However, with a few rare exceptions, most wing adjustments are accomplished by hydraulically actuated forces rather than manual forces. The prior art manually adjustable wings are difficult to adjust, install, or remove; offer few positioning options; and often lack sufficient structural strength to support the weight presented by pushed snow.

The present invention provides methods and apparatuses for an improved manually adjustable snowplow wing. Specifically, the present invention utilizes a manually operable adjustment mechanism to pivotally and securely position the wing in at least three predetermined positions relative to the main snowplow blade, support braces that reinforce the wing when bearing the heaviest loads, and easy connect and disconnect mechanisms.

II. SUMMARY OF THE INVENTION

According to one embodiment of the present invention, a new and improved manually adjustable snowplow wing is provided which increases the operative width of the snowplowing surface, and otherwise captures or directs the flow of snow being plowed.

According to one embodiment of the present invention, a snowplow assembly comprises: 1) a snowplow frame that is attachable to an associated vehicle; 2) a snowplow blade that is attachable to the snowplow frame and that has a snowplow surface for use in plowing associated snow, the snowplow blade comprising upper and lower edges and first and second ends; 3) a wing that is pivotally attached to the first end of the snowplow blade and that has a snowplow surface for use in plowing associated snow; and 4) a manually operable adjustment mechanism that is operatively attached to snowplow blade and the wing, the adjustment mechanism releasably secures the wing in at least two different positions relative to the snowplow blade.

According to another embodiment of the present invention, a method comprises the steps of: (A) providing a snowplow blade that is attached to an associated vehicle and that has a surface for use in plowing associated snow, the snowplow blade comprising upper and lower edges and first and second ends; (B) providing a wing that that has: a forward face having a snowplow surface for use in plowing associated snow, a rear face, a top edge, a bottom edge, an inboard edge, and an outboard edge; (C) providing a manually operable adjustment mechanism comprising: a first member having a first end, a second end, and at least two holes; a second member having a first end, a second end, and a hole; and a positioning pin; (D) pivotally attaching the wing to the first end of the snowplow blade; (E) attaching the first end of the first member to the snowplow blade; (F) attaching the first end of the second member to the rear face of the wing; (G) manually positioning the second member so that the hole in the second member aligns with one of the holes in the first member; and (H) inserting the positioning pin through the aligned holes in the first member and the second member so that the first and second member are securely maintained in a predetermined position.

The advantages of this invention are numerous; with a few non-limiting examples being: the wing is manually adjustable between at least two positions relative to the snowplow blade, the wing is easy to install and remove, the wing is structurally sound due to various reinforcement members, and the snowplow blade and attached wing provide superior snow capturing capabilities.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiment of which will be described in detail in this specification and illustrated in the accompanying drawings which form a part hereof and wherein.

FIGS. 5*a*-5*f* illustrate the snowplow's pivot plate according to another embodiment of the invention; 5*a* is a top view, 5*b* is a rear view, 5*c* is a side view, 5*d* is a front view, 5*e* is an above-rear outboard perspective view, and 5*f* is an above-rear inboard perspective view.

FIGS. 6A-6D illustrate the snowplow's wing; 6A is a top view, 6B is a rear view, 6C is a side view, and 6D is an above-rear perspective view.

FIGS. 6*a*-6*d* illustrate the snowplow's wing according to another embodiment of the invention; 6*a* is a top view, 6*b* is a rear view, 6*c* is a side view, and 6*d* is an above-rear perspective view.

FIGS. 7A-7E illustrate the snowplow's wing, with various component pieces removed; 7A demonstrates the angle of the dimple on the upper rear of the wing, 7B shows the dimple when the wing is closed against the snowplow's first end; 7C is a front view of the wing, 7D is an above-rear perspective view of the wing, 7E is a top view of the wing.

Figure 8:
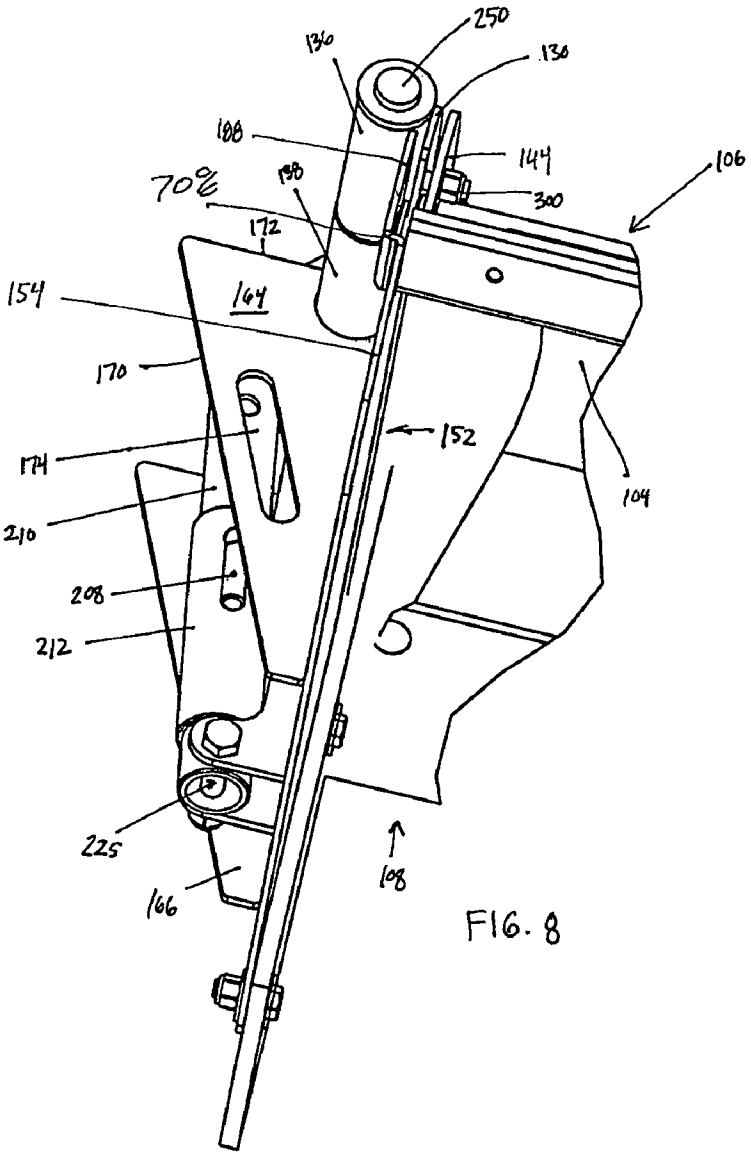

FIG. 8 is a top/front perspective view of the wing assembled onto the pivot plate; generally demonstrating the improved fit of the wing due to the addition of the dimple.

Figure 8A:
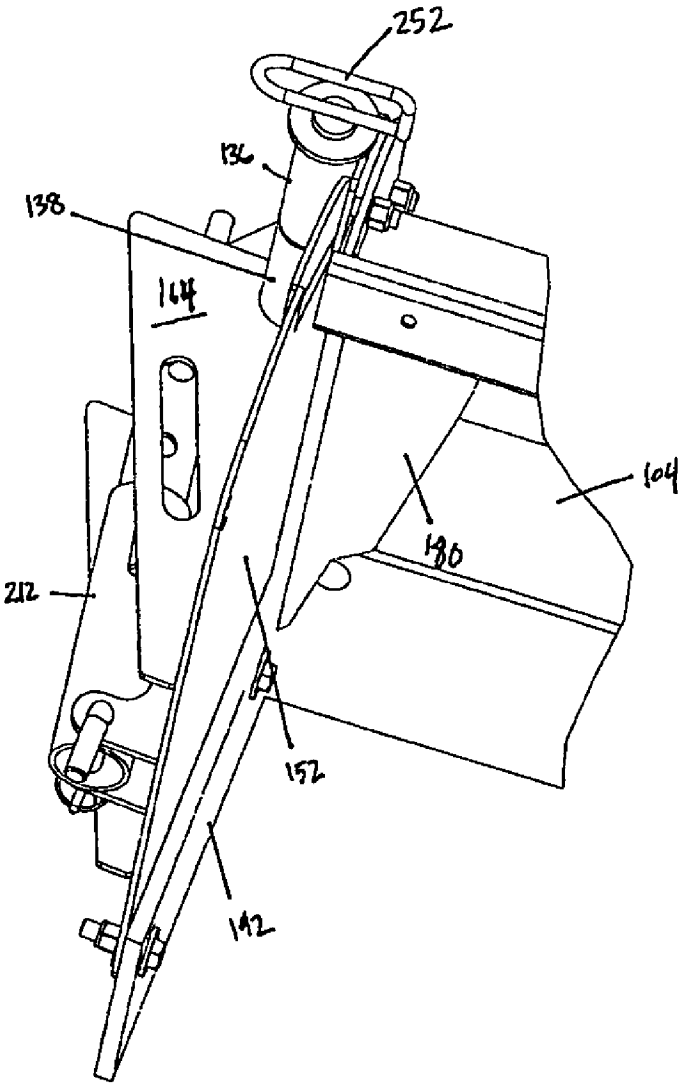

FIG. 8A is an above-front perspective view of the wing assembled onto the pivot plate; and demonstrating additional component parts according to other embodiments of the invention.

IV. DETAILED DESCRIPTION OF THE INVENTION

Figure 1:
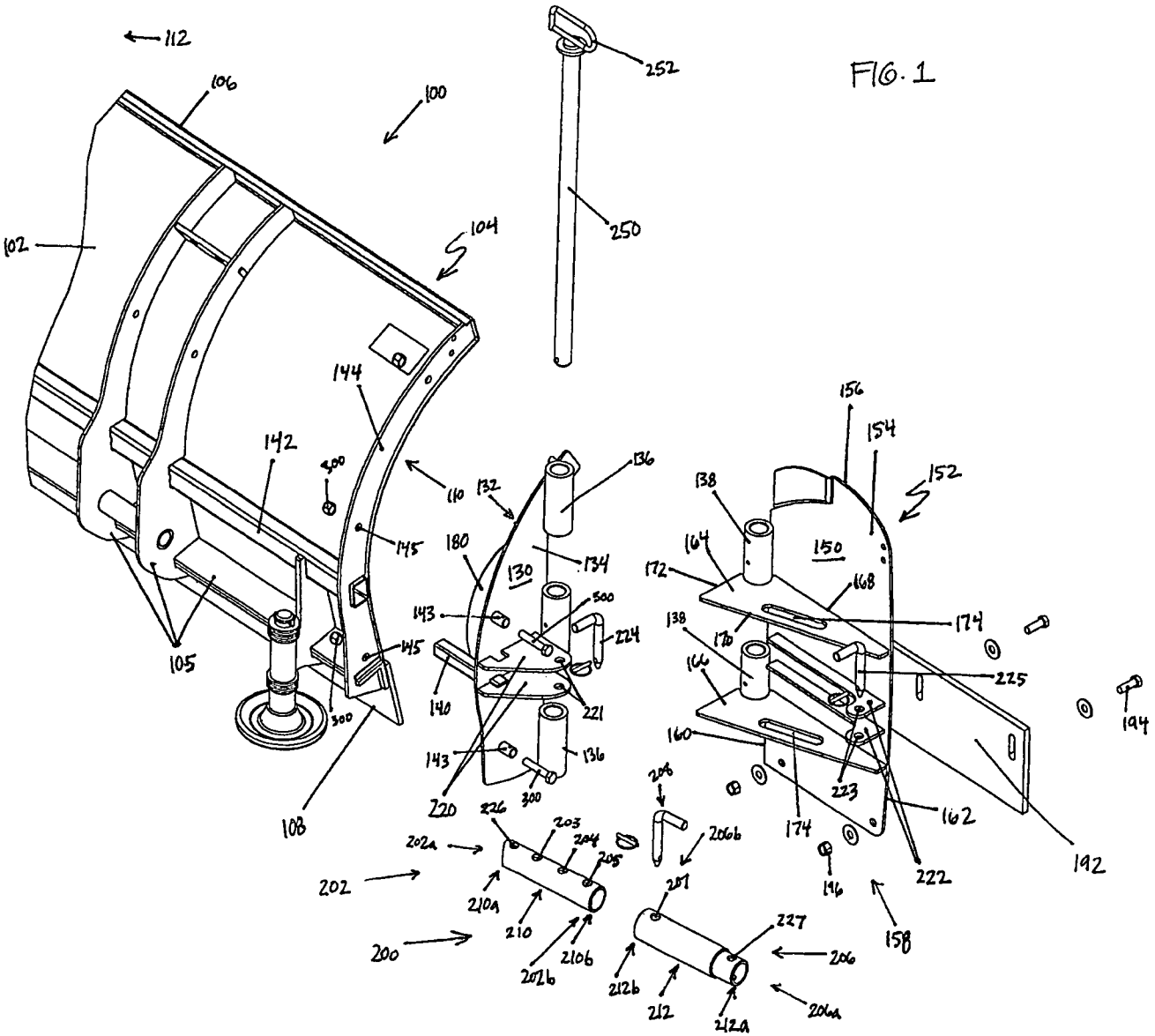
FIG. 1 is an assembly view showing certain embodiments of the snowplow assembly of the present invention.

Referring now to the drawings wherein the showings are for purposes of illustrating embodiments of the invention only and not for purposes of limiting the same, FIG. 1 shows an exploded view of one embodiment of the current invention. Snowplow assemblies generally consist of two major components: the snowplow frame 10 (not shown) and snowplow blade 100. The snowplow blade of the present invention additionally incorporates manually adjustable wing assemblies 150 (discussed in greater detail below) that increase the operative width of the plow snowplow assembly, and otherwise manipulate the directional flow of the plowed snow off of the snowplow blade 100. Snowplow assemblies are typically attached to the front end of an associated vehicle 20 (not shown) using various snowplow frames 10. Snowplow frames are well known in the art, can utilize any device capable—in the mind of a person of ordinary skill in the art, according to sound engineering judgment—of supporting the snowplow to the vehicle 20, and thus will not be discussed in detail. The snowplow frame 10 may also be connected to the rear attachment surface 102 of the snowplow blade 100 in any manner according to sound engineering judgment.

The snowplow blade of the present invention, as illustrated in FIG. 1, has a rear attachment surface 102 opposite the snowplow surface 104. The attachment surface 102 not only provides a surface for attachment of the snowplow frame 10, but also a variety of vertically and horizontally disposed support braces 105. The snowplow surface 104 can be of any shape chosen by a person of ordinary skill in the art, but often forms a "C" shape within which the snow to be plowed is gathered and removed from a road or other surface. The snowplow surface 104 is defined by four edges: an upper edge 106, lower edge 108, a first end 110 and a second end 112 (not shown).

The manually adjustable wings 150 of the present invention can be pivotally attached to the first end 110 and/or second end 112 of the snowplow blade 100, in any manner known to a person of ordinary skill in the art, in order to increase the operative width of the snowplow assembly. The wing 150 has a forward face with a snowplow surface 152 for use in plowing associated snow, a rear face 154, a top edge 156, a bottom edge 158, an inboard edge 160, and an outboard edge 162. The bottom edge 158 of the wing 150 shown in FIG. 1 also has a rubber cutting edge 192, preferably made out of a rubberized material such as recycled tires, operatively attached, such as by bolts 194 and nuts 196. The rubber cutting edge 192 is preferably a flexible membrane assists in keeping the snow within the operating length of the snowplow 100 and improves performance.

Figure 2:
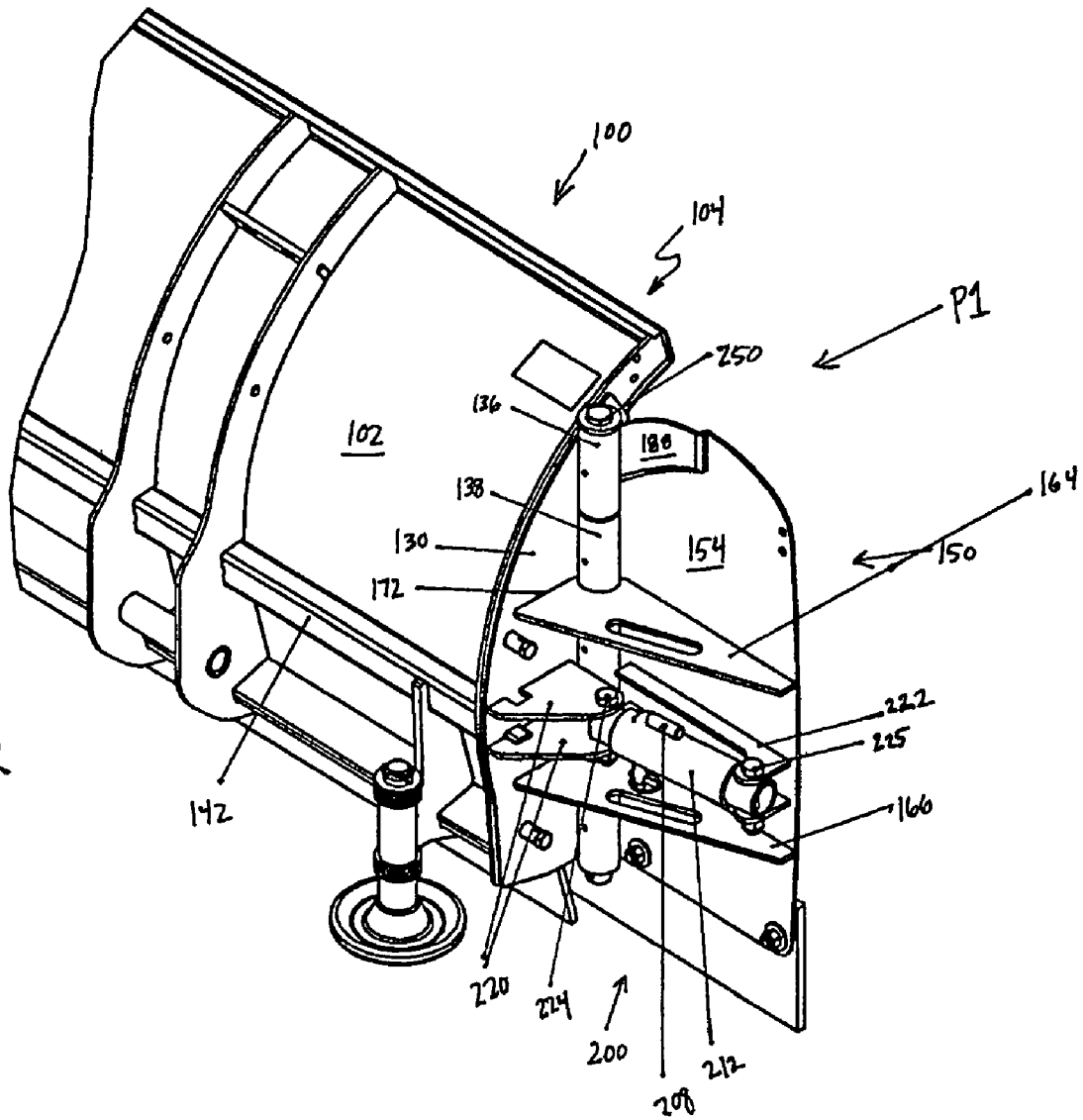
FIG. 2 is a perspective end view of certain embodiments of the snowplow assembly of the present invention, illustrating the relationship between the snowplow blade and the wing in position P1.
Figure 2A:
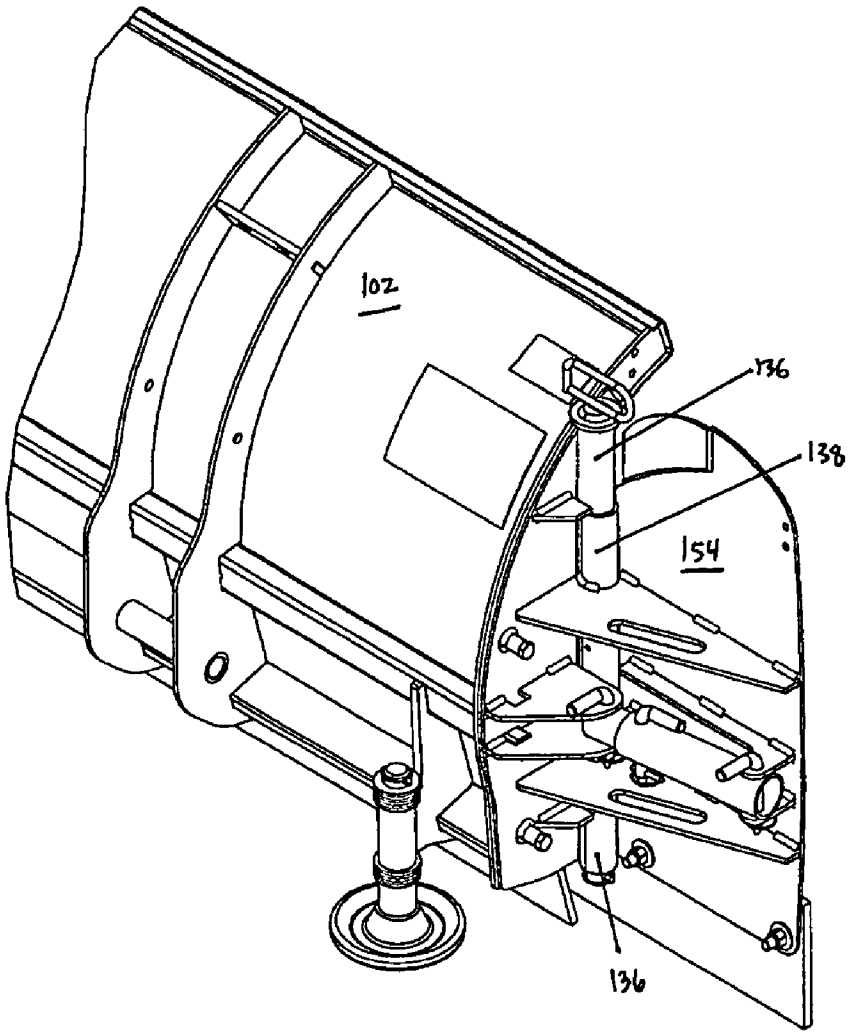
FIG. 2A is a perspective end view of the snowplow assembly of the present invention, illustrating the relationship between the snowplow blade and the wing in position P1, according to other embodiments of the invention.

In the embodiment shown in FIG. 1, the wing has a pair of braces 164, 166 operatively attached to the rear face 154 of the wing 150. The braces 164, 166 have an attachment edge 168 for operative attachment to the wing's rear face 154, a gripping edge 170 opposite the attachment edge 168, and a stop edge 172 that—as shown in FIG. 2—abuts and comes into contact with the snowplow blade's first end 110 when the wing 150 is in a first position P1 substantially parallel to the snowplow blade 100. As such, the stop edge 172 prevents the wing 150 from moving into a position rear of the snowplow blade's plowing surface 104, and acts as a structural support against the forces exerted during snowplowing. In the embodiment shown in FIG. 1, the braces 164, 166 have a lengthwise slot 174 that allows a user to insert their fingers into the brace 164, 166 and in conjunction with the gripping edge 170, manually adjust the position of the wing 150 with relative ease when the adjustment mechanism 200 is in an adjustment mode (the positioning pin 208 is not inserted into first or second member holes).

Figure 3:
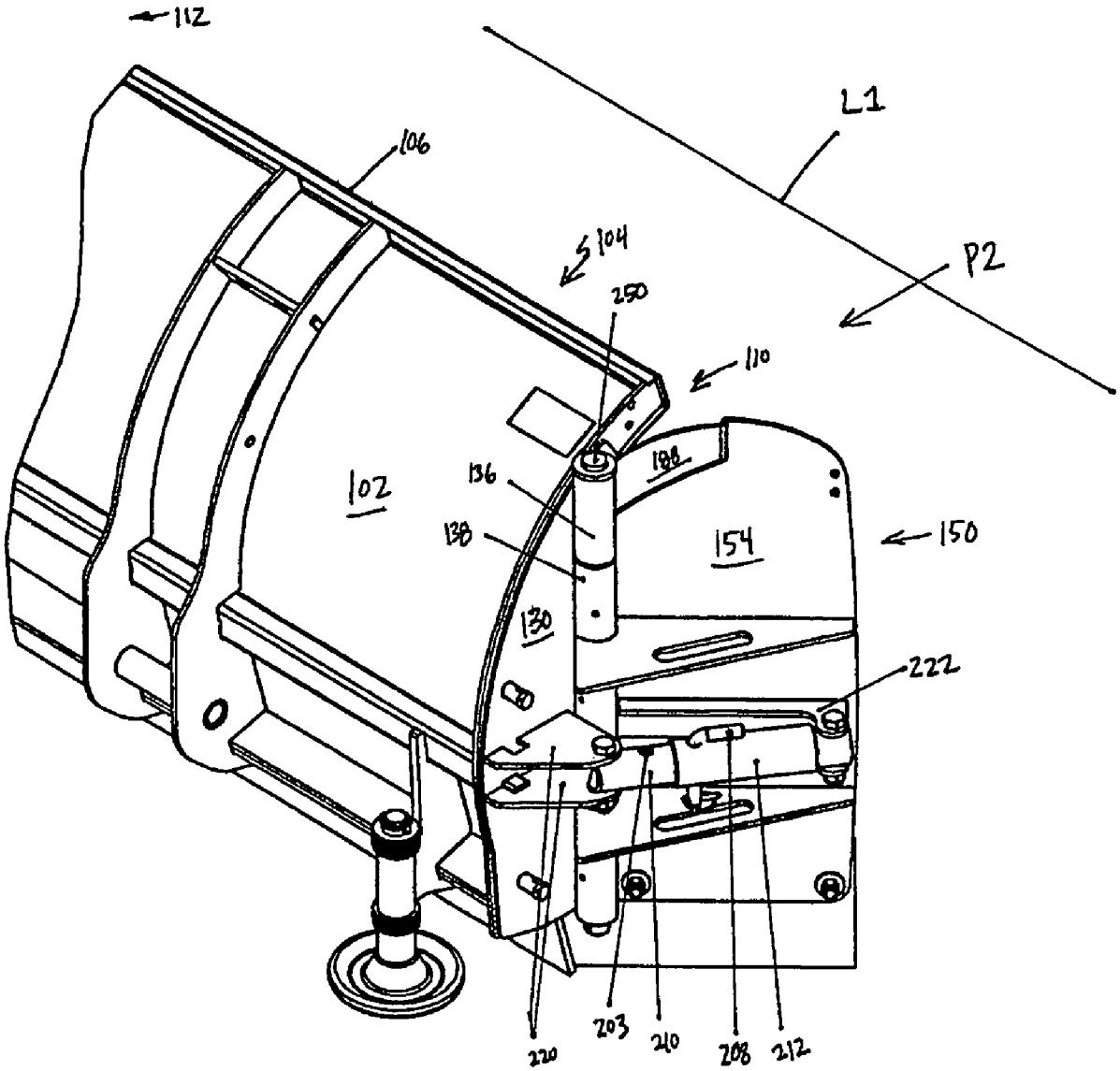
FIG. 3 is a perspective end view of certain embodiments of the snowplow assembly of the present invention, illustrating the relationship between the snowplow blade and the wing in position P2.
Figure 3A:
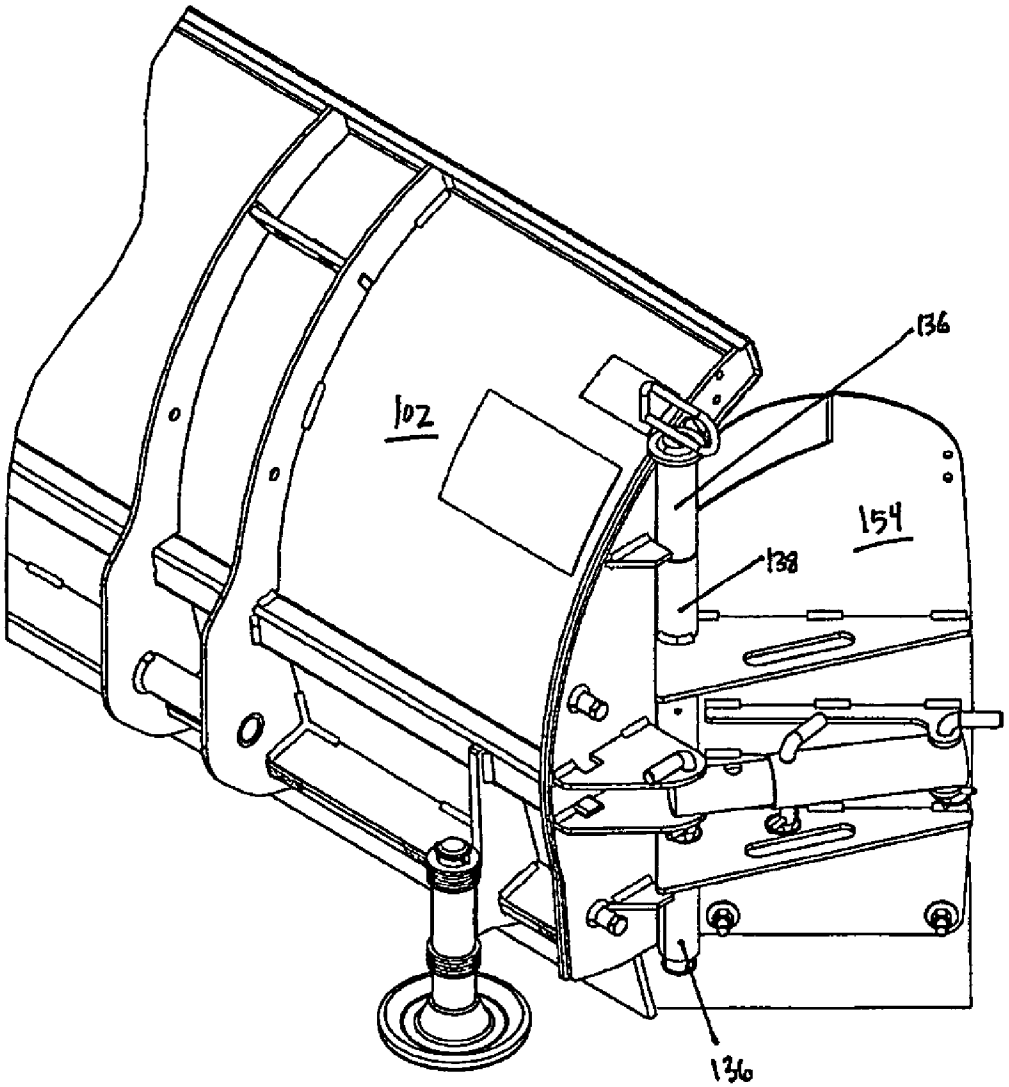
FIG. 3A is a perspective end view of the snowplow assembly of the present invention, illustrating the relationship between the snowplow blade and the wing in position P2, according to other embodiments of the invention.
Figure 4:
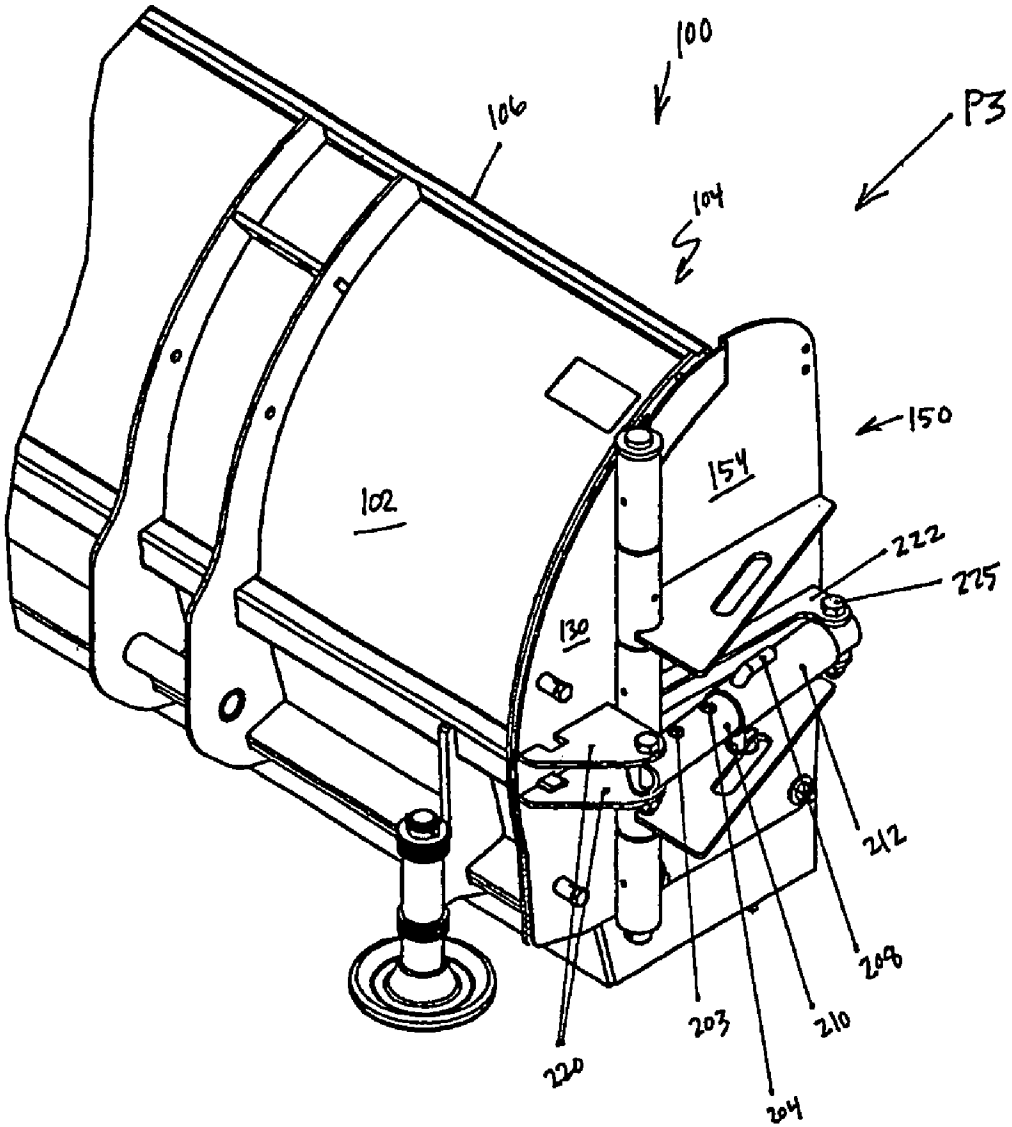
FIG. 4 is a perspective end view of certain embodiments of the snowplow assembly of the present invention, illustrating the relationship between the snowplow blade and the wing in position P3.

The wing's 150 position is adjusted with respect to the snowplow blade 100 by a manually operable adjustment mechanism 200 that is operatively connected to both the snowplow blade 100 and the wing 150. The adjustment mechanism 200 is used to releasably secure the wing 150 in at least two different positions relative to the snowplow blade 100. In one embodiment (not shown), the adjustment mechanism has a first member 202 and a second member 206 that move longitudinally with respect to each other. The first member 202 has a first end 202*a* and a second end 202*b*. The first end 202*a* of the first member 202 is pivotally attached to the snowplow blade 100, is manually pivotable with respect to the snowplow blade 100, and has a series of at least two holes 203, 204, 205 for receiving a positioning pin 208. The second member 206 has a first end 206*a* and a second end 206*b*. The first end 206*a* of the second member 206 is pivotally attached to the rear face 154 of the wing 150, is manually pivotable with respect to the wing 150, and has at least one hole 207 for receiving a positioning pin 208. As generally illustrated in FIGS. 2-4, when the second member 206 is manually positioned so that a hole 207 on the second member 206 aligns with holes 203, 204, 205 in the first member 202, the positioning pin 208 can be inserted through hole 207 and 203, 204, or 205 to releasably and securely maintain the first member 202 to the second member 206 in a predetermined position relative to the snowplow blade 100.

Figure 1A:
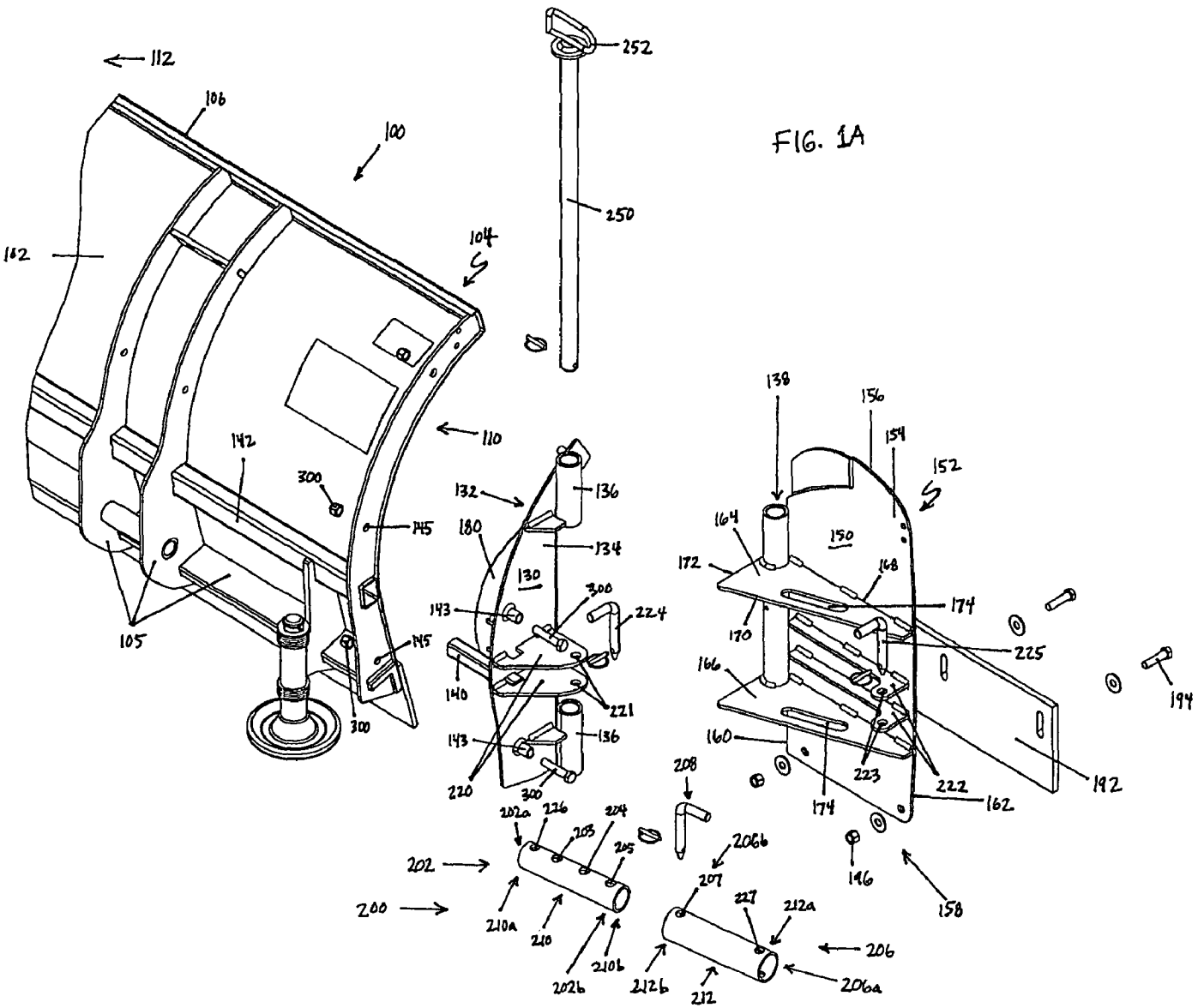
FIG. 1A is an assembly view showing certain other embodiments of the snowplow assembly of the present invention.

In the embodiment shown in FIG. 1, the first member 202 is an inner tube 210, having a first end 210*a* and a second end 210*b*, and is shown as a round tube, but could be of any shape chosen by a person of ordinary skill in the art. The second member 206 is an outer tube 212, having a first end 212*a* and a second end 212*b*, and is also shown as a round tube, but could be of any shape chosen by a person of ordinary skill in the art (alternative embodiments of the aforementioned tubes 210 and 212 are shown in FIGS. 1 and 1A). The second end 212*b* of the outer tube 212 has a diameter of sufficient size to receive the second end 210*b* of the inner tube 210. When the second end 210*b* of the inner tube 210 is received within the second end 212*b* of the outer tube 212, the inner tube 210 and outer tube 212 move longitudinally with respect to each other. When the inner tube 210 and outer tube 212 are manually positioned so that hole 207 in the outer tube 212 aligns with holes 203, 204, or 205 in the inner tube 210, the positioning pin 208 can be inserted to releasably and securely maintain the inner tube 210 to the outer tube 212 in a predetermined position relative to the snowplow blade 100.

In an embodiment shown in FIG. 1, the snowplow blade's first end 110 also comprises an operatively attached pivot plate 130. The pivot plate 130 has an inboard face 132 and an outboard face 134. The pivot plate 130 extends from a location substantially even with the snowplow blade's rear attachment surface 102, to a position substantially perpendicular and forward of the snowplow blade's plowing surface 104. The pivot plate 130 can be attached to the snowplow blade's first end 110 in any manner according to sound engineering judgment. In one embodiment of the invention, illustrated in FIGS. 1 and 2, the pivot plate 130 is attached to the snowplow blade's first end 110 when an insert tube 140 is substantially received into a brace tube 142 operatively attached to the attachment surface 102 of the snowplow blade 100, and securing means 300 are received within aligned holes 143 in the pivot plate 130 and holes 145 in a vertically disposed end brace 144 attached to the rear attachment surface 102. When securing means 300, encompassing any form commonly used by a person of ordinary skill in the art (in one non-limiting example, nuts and bolts), are properly affixed (such as by tightening), the pivot plate 130 effectively serves as the snowplow blade's first end 110.

Figures 5A, 5B, 5C, 5D, 5E, 5F:
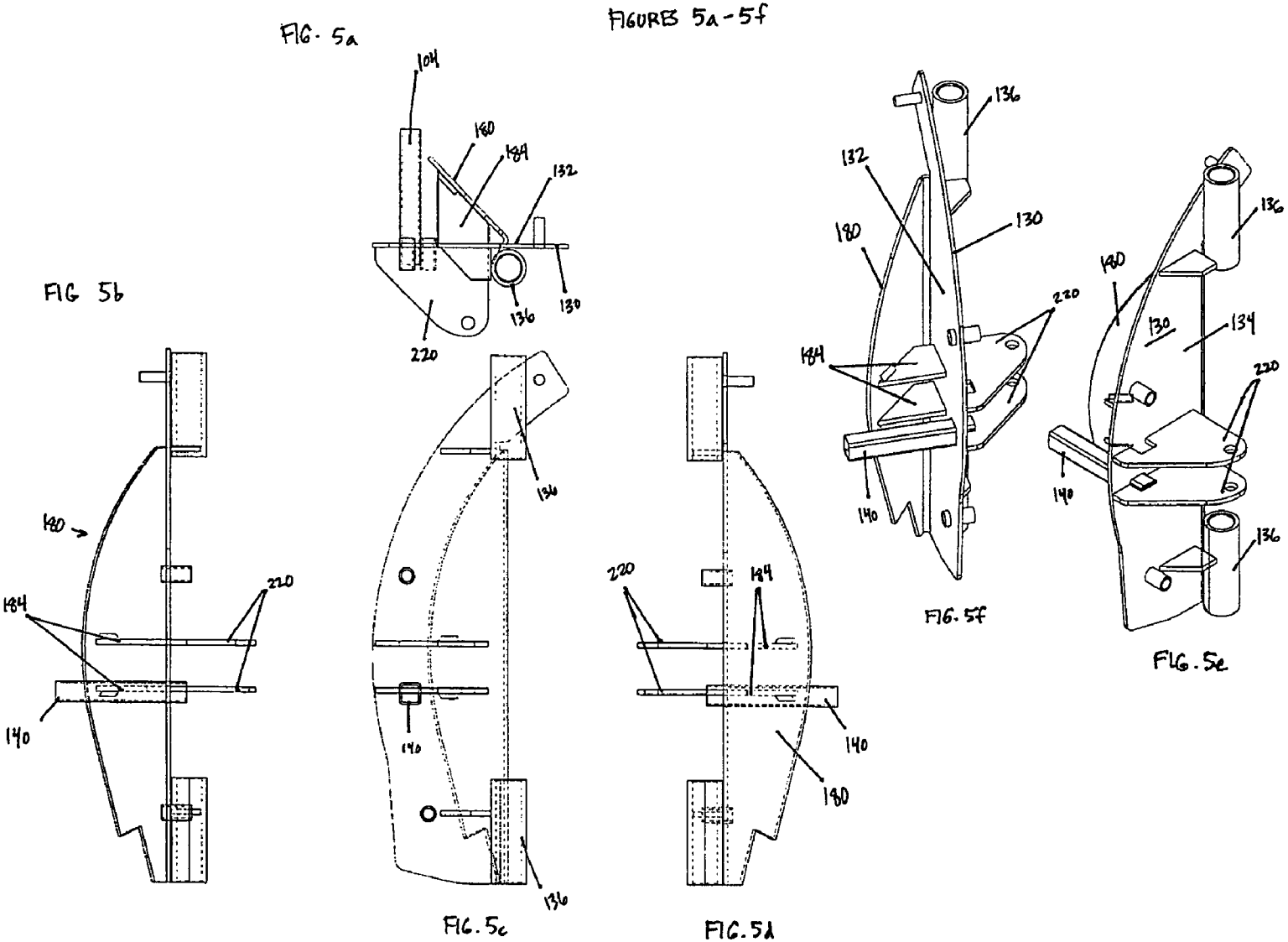
FIGS. 5A-5E illustrate the snowplow's pivot plate; 5A is a top view, 5B is a rear view, 5C is a side view, 5D is a front view, and 5E is an above-rear outboard perspective view.

The perpendicular angle (of substantially 90 degrees) created by attachment of the pivot plate 130 onto the snowplow blade 100, however, can create problems with snow accumulation during plowing. In another embodiment of the present invention, the wing 150 has a curvilinear plate 180 operatively attached to the inboard face 132 of the pivot plate 130 that prevents the accumulation of snow at said location. As shown in FIG. 5A, the curvilinear plate 180 extends at a substantially 45 degree angle from a forward position on the inboard surface 132 of the pivot plate 130 to a position substantially abutting the snowplow surface 104, and in such configuration acts as a deflection surface between the snowplow surface 104 and the pivot plate 130. In another embodiment of the invention, shown in FIG. 5*f*, the curvilinear plate 180 and pivot plate 130 are a unitary component; with the curvilinear plate 180 consisting of a forward portion of the pivot plate 130 bent in a rear inboard angle so as to act as a deflection surface between the snowplow surface 104 and pivot plate 130. In one embodiment of the invention, illustrated in FIGS. 5A-5E, a support gusset 184, extending between a rear face 182 of the curvilinear plate 180 and the inboard face 132 of the pivot plate 130, reinforces the curvilinear plate 180 against the forces exerted during snowplowing. In another embodiment of the invention, illustrated in FIGS. 5*a*-5*f*, the support gusset 184*a* consists of portions of the first pair of adjustment brackets 220 that passes through the pivot plate 130 to reinforce the curvilinear plate 180 against the forces exerted during snowplowing.

Figure 4A:
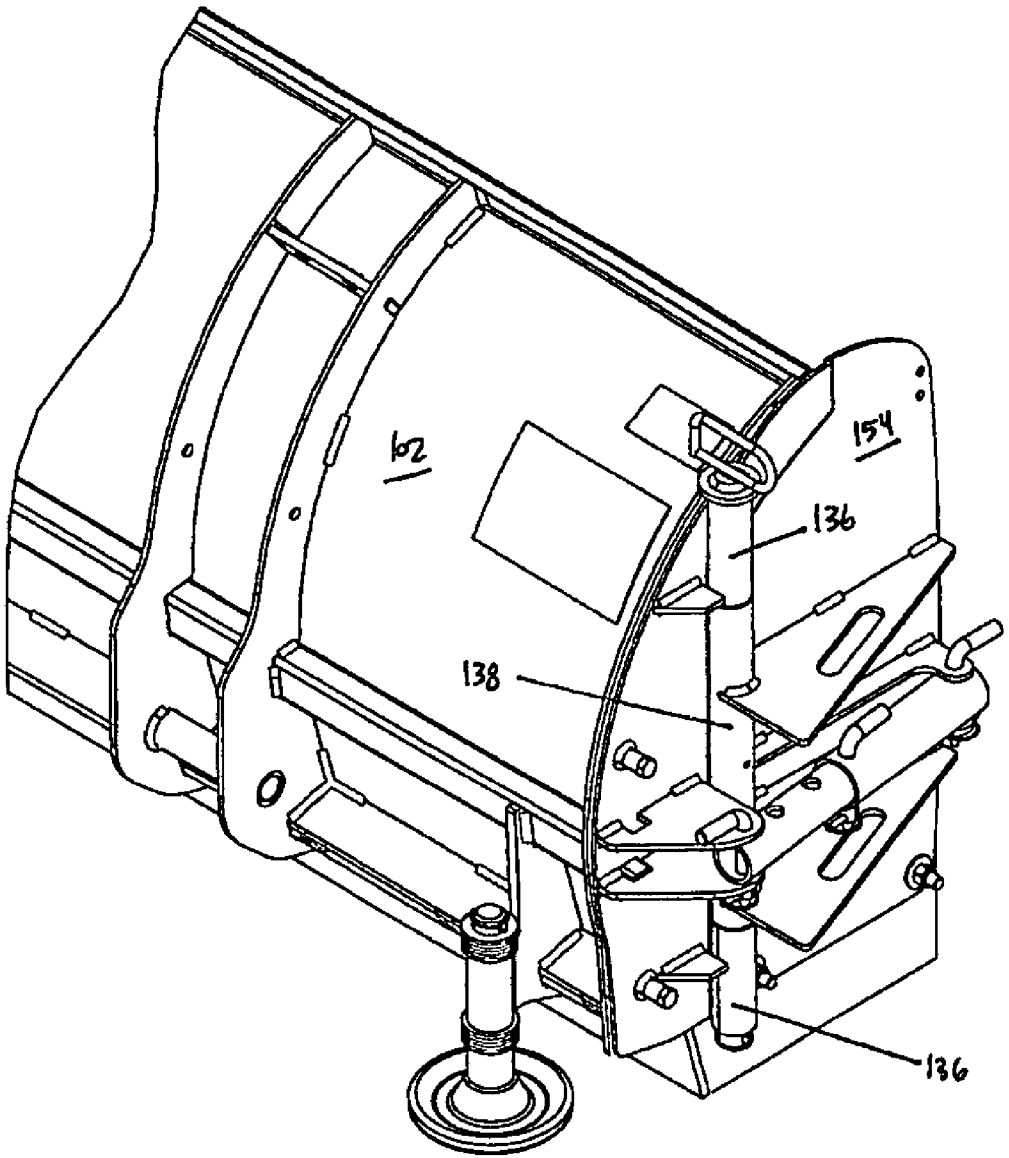
FIG. 4A is a perspective end view of the snowplow assembly of the present invention, illustrating the relationship between the snowplow blade and the wing in position P3, according to other embodiments of the invention.

In one embodiment of the present invention (not shown), the wing 150 is pivotally attached to the outboard face 134 of the pivot plate 130. In another embodiment of the invention, shown generally in FIGS. 1-2, the outboard face 134 of the pivot plate 130 has vertically positioned hinge cylinders 136 with holes, and the rear face 154 of the wing 150 has vertically positioned hinge sleeves 138 with holes at its inboard edge 160. The wing 150 is pivotally attached to the snowplow blade's pivot plate 130 by inserting a hinge pin 250 into aligned holes in the hinge cylinders 136 and hinge sleeves 138. In one embodiment of the present invention, the hinge pin 250 has a handle 252 for easy insertion and removal. In yet another embodiment of the invention, illustrated in FIGS. 1A, 4A, and 6A, the rear face 154 of the wing 150 consists of a single hinge sleeve 138.

In another embodiment of the present invention, the manually operable adjustment mechanism 200 is pivotally attached to both the pivot plate 130 and the wing 150. As shown in FIG. 1, the snowplow blade's 100 pivot plate 130 has a first pair of adjustment brackets 220 operatively attached to the outboard face 134 of the pivot plate 130, and the rear face 154 of the wing 150 has a second pair of attachment brackets 222 operatively attached. Both the first pair of adjustment brackets 220 and the second pair of adjustment brackets 222 have holes 221, 223 for receiving trunnion pins 224, 225. Additionally, the adjustment mechanism's inner tube 210 has a connection aperture 226 for receiving trunnion pin 224 on its first end 210*a*, while the outer tube 212 has a connection aperture 227 for receiving trunnion pin 225 on its first end 212*a*. The inner tube 210 is pivotally attached to the pivot plate 130 when trunnion pin 224 is inserted through aligned holes 221 and connection aperture 226. The outer tube is pivotally attached to the wing 150 when trunnion pin 225 is inserted through aligned holes 223 and connection aperture 227. When the inner tube's second end 210*b* is inserted into the second end 212*b* of the outer tube 212, the inner tube 210 moves longitudinally within the outer tube 212 as the inner tube 210 pivots about the first pair of attachment brackets 220 and the outer tube 212 pivots about the second pair of adjustment brackets 222. Such longitudinal and pivotal movement permits alignment of hole 207 with holes 203, 204, or 205, and insertion of positioning pin 208 through said aligned holes.

In another embodiment of the invention, the wing 150 is selectively adjustable, and securely maintained, in at least three predetermined positions with respect to the snowplow blade 100 by virtue of the pivotal attachment of the inner tube 210 to the pivot plate, pivotal attachment of the outer tube to the wing 150, and longitudinal movement of the inner tube 210 within the outer tube 212. In the first position P1, the positioning pin 208 is received within aligned holes 207 in the outer tube 212 and a first hole 203 in the inner tube 210. As shown in FIG. 2, in position P1 the wing 150 extends substantially parallel with respect to the snowplow blade 100. In the second position P2, the positioning pin 208 is received within aligned holes 207 in the outer tube 212 and a second hole 204 in the inner tube 210. In position P2, one embodiment of which is shown in FIG. 3, the wing 150 is positioned at an angle between 1 and 89 degrees relative to a line L1 extending parallel to the snowplow blade 100. In the third position P3, the positioning pin 208 is received within aligned holes 207 in the outer tube 212 and a third hole 205 in the inner tube 210. As shown in FIG. 4, in position P3 the wing 150 extends substantially perpendicular to the snowplow blade 100.

Figures 7A, 7B, 7C, 7D, 7E:
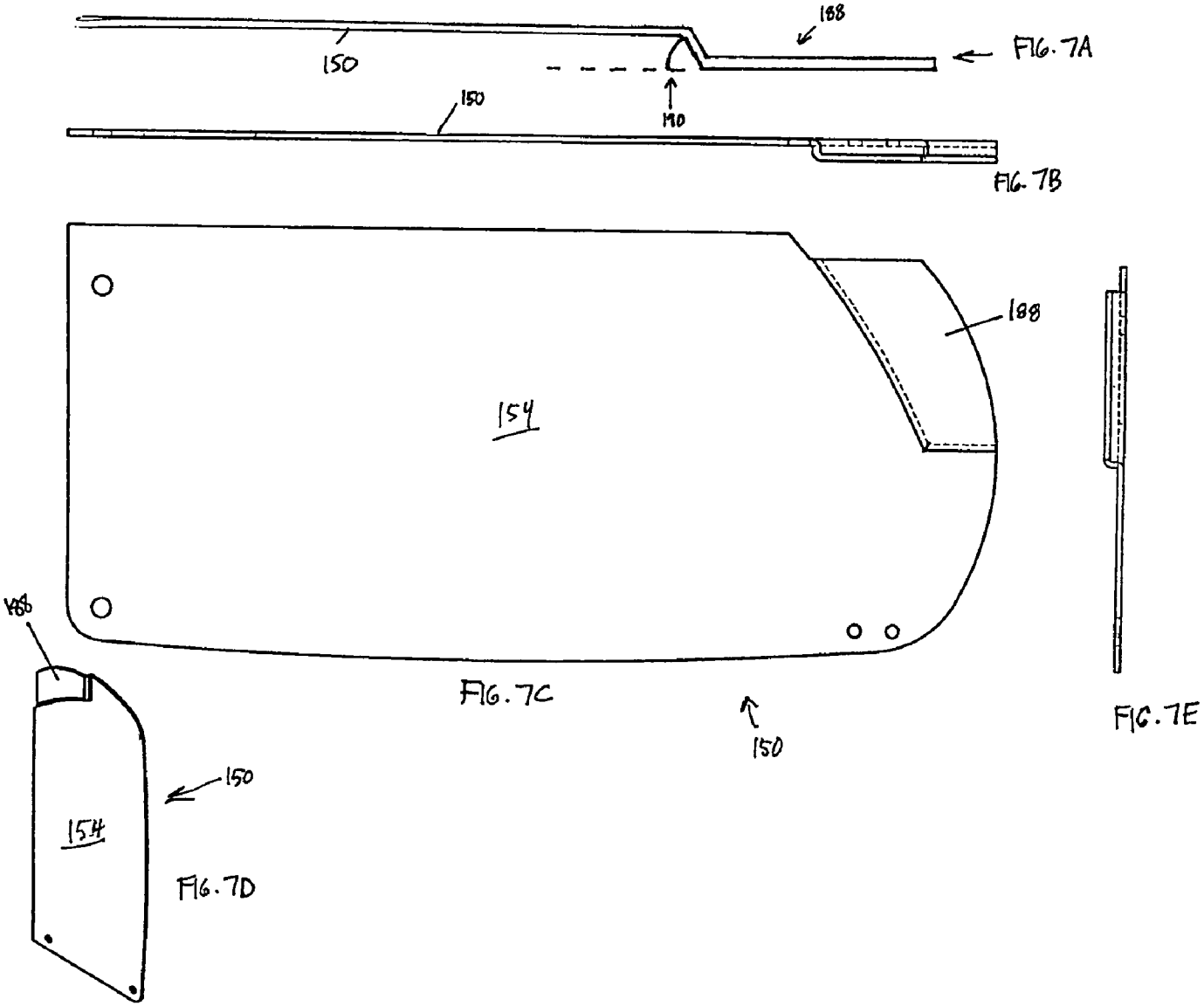

In yet another embodiment of the present invention, providing an especially snug fit between the wing 150 and snowplow blade 100, a preferred orientation of a generally planar wing 150 is shown. Through testing and design, it has been determined that a step or "dimple" 188 in the generally planar orientation of the wing 150 is desirable. When the wing 150 is in the closed position, as shown in FIG. 4, clearance issues as well as a desire to maintain snow within the confines of the snowplow surface 104, were improved and helped by modifying the planar configuration of wing 150 to include dimple 188. As shown in FIG. 7, the generally planar orientation of wing 150 is slightly modified in the upper rear face 154 area to accommodate the configuration of the snowplow blade's first end 110 and to allow a tight fit when in a closed position as can be best seen in FIG. 8, and greater detail in FIG. 7A, a detent or dimple 188 is shown in exaggerated form. The exaggeration is desirable to illustrate that angle 190 is preferably 70 degrees so as to facilitate effective manufacture of the dimple as well as to provide the requisite strength in the wing 150.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A snowplow assembly for a vehicle comprising:

a snowplow frame that is attachable to an associated vehicle;

a snowplow blade that is attachable to the snowplow frame and that has a snowplow surface for use in plowing associated snow, the snowplow blade comprising upper and lower edges and first and second ends;

a wing that is pivotally attached to the first end of the snowplow blade and that has a snowplow surface for use in plowing associated snow;

a manually operable adjustment mechanism that is operatively attached to snowplow blade and the wing, the adjustment mechanism releasably secures the wing in at least two different positions relative to the snowplow blade;

the manually operable adjustment mechanism further comprises:

a first member and a second member that move longitudinally with respect to each other; the first member having a series of holes for receiving a positioning pin, the first member being pivotally attached to the snowplow blade, and manually pivotable with respect to the snowplow blade; the second member having holes for receiving a positioning pin, the second member being pivotally attached to the wing, and manually pivotable with respect to the wing;

a positioning pin to securely maintain the first member to the second member in a predetermined position when holes in the first member and second member align; and, wherein the wing further comprises:

a forward face and a rear face, a top edge and a bottom edge, and an inboard edge and an outboard edge; and, a pair of braces, each brace having an attachment edge operatively connecting the brace to the wing rear face, a gripping edge, and a stop edge adapted to abut the snowplow blade's first end and prevent the wing from moving into a position rear of the blade's plowing surface.

2. The snowplow assembly for a vehicle of claim 1, wherein:

at least one of the wing's braces further comprises a lengthwise slot for manual adjustment of the wing relative to the plow blade.

3. The snowplow assembly for a vehicle of claim 2, wherein:

the snowplow blade's first end further comprises a pivot plate having an inboard face and an outboard face, the pivot plate extending along a line substantially perpendicular and forward of the plowing surface; and the wing is pivotally attached to the outboard face of the pivot plate.

4. The snowplow assembly for a vehicle of claim 3, wherein:

the pivot plate further comprises vertically positioned hinge cylinders;

the wing further comprises at least one vertically positioned hinge sleeve; and a hinge pin pivotally connects the wing to the pivot plate when inserted through aligned holes in the pivot plate's cylinders and the wing's sleeve.

5. The snowplow assembly for a vehicle of claim 4, wherein:

the hinge pin further comprises an operatively attached handle.

6. The snowplow assembly for a vehicle of claim 5, wherein:

the pivot plate further comprises holes for receiving securing means, and an insert tube;

the snowplow blade attachment surface further comprises an operatively attached brace tube, having a hole that receives the pivot plate's insert tube; a vertically disposed end brace, having holes for receiving securing means; and securing means, operatively attaching the pivot plate to the snowplow blade when the insert tube is substantially received within the brace tube.

7. The snowplow assembly for a vehicle of claim 6, wherein:

the snowplow blade's pivot plate further comprises a first pair of adjustment brackets, operatively attached to the outboard face of the pivot plate, having holes that receive trunnion pins;

the wing further comprises a second pair of adjustment brackets, operatively attached to the rear face of the wing, having holes that receive trunnion pins;

the manually operable adjustment mechanism further comprises an inner tube having connection apertures that receive trunnion pins; an outer tube having connection apertures that receive trunnion pins; wherein the inner tube is pivotally attached to the first pair of attachment brackets when trunnion pins are inserted through the first adjustment bracket's holes and the inner tube's connection apertures;

the outer tube is pivotally attached to the second pair of attachment brackets when trunnion pins are inserted through the second adjustment bracket's holes and the outer tube's connection apertures; and the inner tube moves longitudinally within the outer tube as the inner tube pivots about the first pair of attachment brackets and the outer tube pivots about the second pair of attachment brackets.

8. The snowplow assembly for a vehicle of claim 7, wherein:

the wing is selectively adjustable into at least three positions with respect to the snowplow blade;

a first position, where the positioning pin is received within a hole in the outer tube and a first hole in the inner tube and the wing extends substantially parallel to the snowplow blade;

a second position, where the positioning pin is received within a hole in the outer tube and a second hole in the inner tube and the wing is positioned at an angle between 1 and 89 degrees relative to a line extending parallel to the snowplow blade; and a third position, where the positioning pin is received within a hole in the outer tube and a third hole in the inner tube and the wing extends substantially perpendicular to the snowplow blade.

9. The snowplow assembly for a vehicle of claim 8, wherein:

the wing further comprises a curvilinear plate, operatively attached to the inboard face of the wing, and extending into a position substantially abutting the snowplow blade's plowing surface so as to create a deflection surface between the plowing surface of the snowplow blade and the pivot plate; and a support gusset extending between a rear face of the curvilinear plate and the inboard face of the pivot plate.

10. The snowplow assembly for a vehicle of claim 9, wherein:

the wing further comprises a dimple in the generally planar configuration of the snowplow surface.

11. A method comprising the steps of:

(A) providing a snowplow blade that is attached to an associated vehicle and that has a surface for use in plowing associated snow, the snowplow blade comprising upper and lower edges and first and second ends;

(B) providing a wing that that has: a forward face having a snowplow surface for use in plowing associated snow, a rear face, a top edge, a bottom edge, an inboard edge, and an outboard edge;

(C) providing a manually operable adjustment mechanism comprising: a first member having a first end, a second end, and at least two holes; a second member having a first end, a second end, and a hole; and a positioning pin;

(D) pivotally attaching the wing to the first end of the snowplow blade;

(E) attaching the first end of the first member to the snowplow blade;

(F) attaching the first end of the second member to the rear face of the wing;

(G) manually positioning the second member so that the hole in the second member aligns with one of the holes in the first member; and (H) inserting the positioning pin through the aligned holes in the first member and the second member so that the first and second member are securely maintained in a predetermined position;

wherein step (C) further comprises providing a manually operable adjustment mechanism where the first member is an inner tube, and the second member is an outer tube having a diameter large enough to receive the second end of the inner tube;

wherein step (G) further comprises inserting the second end of the inner tube into the second end of the outer tube prior to manually positioning the outer tube so that the hole in the outer tube aligns with one of the holes in the inner tube; and, wherein step (B) further comprises providing a wing having a pair of braces, each of the braces having an attachment edge operatively connecting the brace to the wing rear face, a gripping edge, a stop edge adapted to abut the snowplow blade's first end and prevent the wing from moving into a position rear of the blade's plowing surface, and a lengthwise slot for manual adjustment of the wing relative to the snowplow blade.

12. The method of claim 11, wherein:

step (A) further comprises providing a snowplow blade with a first end that is a pivot plate extending along a line substantially perpendicular and forward of the plowing surface, the pivot plate having an inboard face and an outboard face, with vertically positioned hinge cylinders with holes, the hinge cylinders being operatively attached to the pivot plate's outboard surface;

step (B) further comprises providing a wing having at least one vertically positioned hinge sleeve with holes, the hinge sleeve being operatively attached at the inboard edge of the wing's rear face; and, step (D) further comprises providing a hinge pin with a handle, and inserting the hinge pin through the aligned holes in the hinge sleeve and the hinge cylinders.

13. The method of claim 12, wherein:

step (A) further comprises 1) providing a snowplow blade with a) securing means; b) a pivot plate having a holes for receiving securing means, and an insert tube; and c) an attachment surface opposite the plowing surface, the attachment surface having an operatively attached brace tube with a hole that receives the pivot plate's insert tube, and a vertically disposed end brace, having holes for receiving securing means; and 2) operatively attaching the pivot plate to the snowplow blade by a) inserting the insert tube into the brace tube, b) inserting securing means through holes in the pivot plate and the vertically disposed end brace, and c) tightening securing means.

14. The method of claim 13, wherein:

step (A) further comprises providing a pivot plate having a first pair of adjustment brackets operatively attached to the outboard face of the pivot plate, the first pair of attachment brackets having holes that receive trunnion pins;

step (B) further comprises providing a wing having a second pair of adjustment brackets operatively attached to the rear face of the wing, the second pair of attachment brackets having holes that receive trunnion pins;

step (C) further comprises providing a manually operable adjustment mechanism having 1) an inner tube with connection apertures that receive trunnion pins, and 2) an outer tube having connection apertures that receive trunnion pins;

step (E) further comprises pivotally attaching the inner tube to the pivot plate by inserting trunnion pins into aligned holes in the first pair of attachment brackets and connection apertures on the inner tube;

step (F) further comprises pivotally attaching the outer tube to the wing by inserting trunnion pins into aligned holes in the second pair of attachment brackets and connection apertures on the outer tube; and, step (G) further comprises moving the inner tube longitudinally within the outer tube by: 1pivoting the inner tube with respect to the first pair of attachment brackets, 2) pivoting the outer tube with respect to the second pair of attachment brackets, until 3) a hole in the second member aligns with one of the holes in the first member.

15. The method of claim 14, wherein:

step (H) further comprises securely maintaining the wing in one of three predetermined positions, 1) a first position, where the positioning pin is received within a hole in the outer tube and a first hole in the inner tube and the wing extends substantially parallel to the plow blade; 2) a second position, where the positioning pin is received within a hole in the outer tube and a second hole in the inner tube and the wing is positioned at an angle between 1 and 89 degrees relative to a line extending parallel to the plow blade; and 3) a third position, where the positioning pin is received within a hole in the outer tube and a third hole in the inner tube and the wing extends substantially perpendicular to the plow blade.

* * * * *